US009155130B2

(12) United States Patent
Shan et al.

(10) Patent No.: US 9,155,130 B2
(45) Date of Patent: Oct. 6, 2015

(54) METHOD TO DETECT A POSITION OF A COOKWARE UTENSIL IN AN INDUCTION COOKTOP SYSTEM

(75) Inventors: Mingwei Shan, Louisville, KY (US); Gregory Francis Gawron, Jeffersontown, KY (US); Daniel Vincent Brosnan, Louisville, KY (US); John Michael Kulp, Jr., Louisville, KY (US)

(73) Assignee: General Electric Company, Schenectady, NY (US)

( * ) Notice: Subject to any disclaimer, the term of this patent is extended or adjusted under 35 U.S.C. 154(b) by 517 days.

(21) Appl. No.: 13/482,018

(22) Filed: May 29, 2012

(65) Prior Publication Data

US 2013/0320000 A1 Dec. 5, 2013

(51) Int. Cl.
*H05B 6/12* (2006.01)
*H05B 6/06* (2006.01)
*H05B 6/08* (2006.01)

(52) U.S. Cl.
CPC ..... *H05B 6/062* (2013.01); *H05B 2213/05* (2013.01)

(58) Field of Classification Search
CPC ..... H05B 6/062; H05B 2213/05
USPC ..... 219/448.11, 518, 620–622, 625–626, 219/662–668, 447.1
See application file for complete search history.

(56) References Cited

U.S. PATENT DOCUMENTS

| | | | | |
|---|---|---|---|---|
| 3,770,928 | A * | 11/1973 | Kornrumf et al. | 219/626 |
| 3,796,850 | A | 3/1974 | Moreland, II et al. | |
| 3,820,005 | A * | 6/1974 | Steigerwald | 363/96 |
| 4,016,392 | A * | 4/1977 | Kobayashi et al. | 219/626 |
| 4,095,076 | A * | 6/1978 | Tsumori et al. | 219/626 |
| 4,277,667 | A * | 7/1981 | Kiuchi | 219/664 |
| 4,319,109 | A * | 3/1982 | Bowles | 219/626 |
| 4,356,371 | A * | 10/1982 | Kiuchi et al. | 219/626 |
| 5,886,519 | A | 3/1999 | Masreliez et al. | |
| 6,246,033 | B1 * | 6/2001 | Shah | 219/447.1 |
| 7,186,954 | B2 | 3/2007 | Wilkins | |
| 2006/0125472 | A1 | 6/2006 | Howard et al. | |
| 2010/0181304 | A1 | 7/2010 | Gutierrez et al. | |
| 2011/0133727 | A1 | 6/2011 | Youngquist et al. | |

* cited by examiner

*Primary Examiner* — Dana Ross
*Assistant Examiner* — Lindsey C Teaters
(74) *Attorney, Agent, or Firm* — Dority & Manning, P.A.

(57) ABSTRACT

An induction cooktop appliance system and method for controlling the induction cooktop appliance based on a cookware position is provided. A variable power signal can be applied to an induction coil from an inverter. The power signal can be driven at a test frequency and an operating frequency. An electrical signal can be detected across a shunt resistor based on the test frequency and a cookware position can be determined based on the electrical signal. The operating frequency supplied to the induction coil can be modified based on determined cookware position.

9 Claims, 4 Drawing Sheets

METHOD TO DETECT A POSITION OF A COOKWARE UTENSIL IN AN INDUCTION COOKTOP SYSTEM

FIELD OF THE INVENTION

The present subject matter relates generally to an induction cooktop system, and more particularly to, detecting a position of cookware utensil placed on the induction cooktop.

BACKGROUND OF THE INVENTION

Induction cooking appliances are more efficient, have greater temperature control precision and provide more uniform cooking than other conventional cooking appliances. In conventional cooktop systems, an electric or gas heat source is used to heat cookware in contact with the heat source. This type of cooking is inefficient because only the portion of the cookware in contact with the heat source is directly heated. The rest of the cookware is heated through conduction that causes non-uniform cooking throughout the cookware. Heating through conduction takes an extended period of time to reach a desired temperature.

In contrast, induction cooking systems use electromagnetism which turns cookware of the appropriate material into a heat source. A power supply provides a signal having a frequency to the induction coil. When the coil is activated a magnetic field is produced which induces a current on the bottom surface of the cookware. The induced current on the bottom surface then induces even smaller currents (eddy currents) within the cookware thereby providing heat throughout the cookware.

Due to the efficiency of induction cooking appliances, precise control of a selected cooking temperature is needed. Some systems include a position sensor to determine the position of the cookware in relation to the induction coil to improve efficiency of the induction cooking appliance. Examples of position sensors include capacitance-based position sensors, laser based position sensors, eddy-current sensing position sensors, and linear displacement transducer-based position sensors. However, each of these sensors has disadvantages including impractical size, complexity, and cost.

Thus, a need exists for an improved induction cooktop control method that overcomes the above-mentioned disadvantages. A system and method that can improve cookware position detection would be particularly useful.

BRIEF DESCRIPTION OF THE INVENTION

Aspects and advantages of the invention will be set forth in part in the following description, or may be obvious from the description, or may be learned through practice of the invention.

One exemplary aspect of the present disclosure is directed to an induction cooktop appliance having a user interface configured to receive a user input and provide visual information to a user and an inverter configured to output a power signal at a test frequency and at an operating frequency. The appliance can also include an induction coil coupled to the inverter such that the induction coil receives the power signal. The appliance can also include a shunt resistor coupled to the induction coil. A controller can be configured to control the inverter to output the power signal at the test frequency, detect an electrical signal across the shunt resistor when the power signal is at the test frequency, and determine a position of a cookware utensil based on the electrical signal.

Another exemplary aspect of the present disclosure is directed to a method of controlling an induction cooktop appliance. The method includes supplying a test frequency to a coil of the induction cooktop appliance; detecting an electrical signal across a shunt resistor when the test frequency is supplied to the coil; determining a position of the cookware utensil based on the electrical signal; and controlling the induction cooktop appliance at an operating frequency different from the test frequency based on the position of the cookware utensil.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
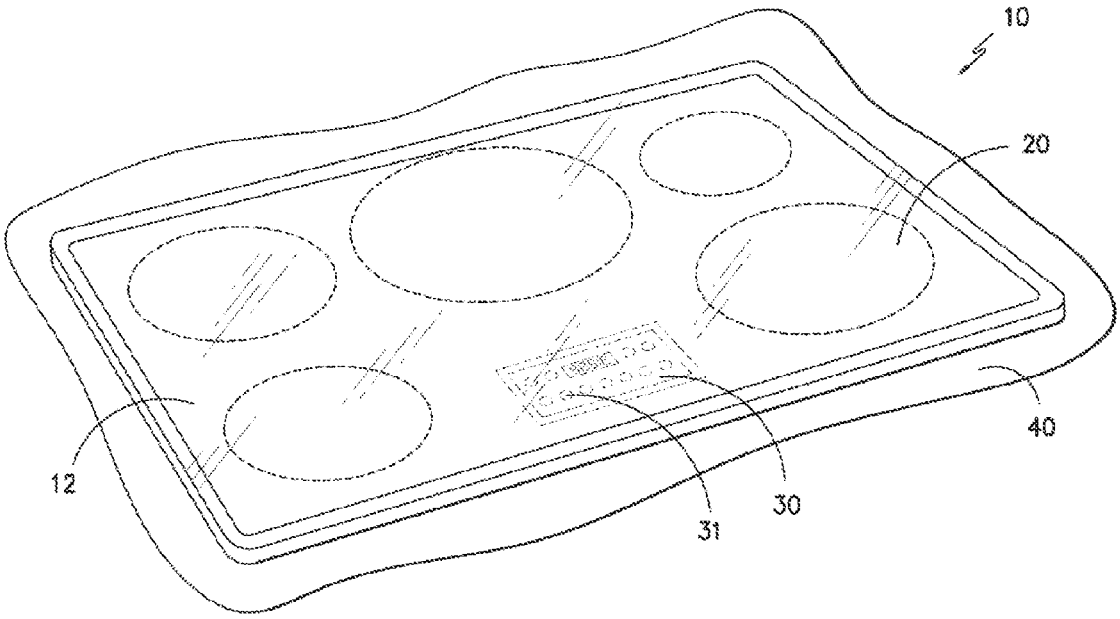
FIG. 1 provides a top, perspective view of an exemplary induction cooking system according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure relates to an induction cooktop appliance system and method for controlling the induction cooktop appliance based on a cookware position. A variable power signal can be applied to an induction coil from an inverter. The power signal can be driven at a test frequency and an operating frequency. An electrical signal can be detected across a shunt resistor based on the test frequency and a cookware position can be determined based on the electrical signal. The operating frequency supplied to the induction coil can be modified based on determined cookware position.

According to aspects of the present disclosure, an induction cooktop system and method of detecting cookware utensil position using a test frequency can improve system efficiency by more precisely controlling operating frequencies based on a specific cookware utensil characteristic, namely a position of the cookware utensil. Reliability of the system and more particularly, reliability of control of a signal having high frequency and high power provided to an induction coil of the system can also be improved. The life of the devices of the induction cooktop system can also be prolonged when coil control has more precision. In addition, an indication of the position of the cookware utensil can be beneficial because exposure of an electromagnetic field created by the coil can be reduced when the cookware utensil is centered above the coil.

FIG. 1 provides a top, perspective view of an exemplary induction cooking system according to an exemplary embodiment of the present disclosure. Cooktop 10 can be installed in a chassis 40 and in various configurations such as in cabinetry in a kitchen, coupled with one or more ovens or as a stand-alone appliance. Chassis 40 can be grounded. Cooktop 10 includes a horizontal surface 12 that can be glass. Induction coil 20 may be provided below horizontal surface 12. Cooktop 10 can include any number of induction coils from a single coil to a plurality of coils. In addition, the coils can have various diameters.

Cooktop 10 is provided by way of example only and is in no way limited in configuration. For example, a cooktop having one or more induction coils in combination with one or more electric or gas burner assemblies can be provided. In addition various combinations of number of coils, position of coils and/or size of coils can be used.

A user interface 30 can provide visual information to a user and allow a user to select various options for the operation of the cooktop 10. For instance, displayed options can include a desired coil, a desired cooking temperature, and/or other options. The user interface 30 can be any type of input device and can have any configuration. In the illustrated embodiment, the user interface 30 is located within a portion of the horizontal surface 30. Alternatively, the user interface can be positioned on a vertical surface near a front side of the cooktop 10 or anywhere convenient for a user to access during operation of the cooktop.

In a particular embodiment, the user interface 30 can include a capacitive touch screen input device component 31. The input component 31 can allow for the selective activation, adjustment or control of any or all induction coils 20 as well as any timer features or other user adjustable inputs. One or more of a variety of electrical, mechanical or electro-mechanical input devices including rotary dials, push buttons, toggle/rocker switches, and/or touch pads can also be used singularly or in combination with the capacitive touch screen input device component 31. The user interface 30 can also include a display component, such as a digital or analog display device designed to provide operational feedback to a user.

Figure 2:
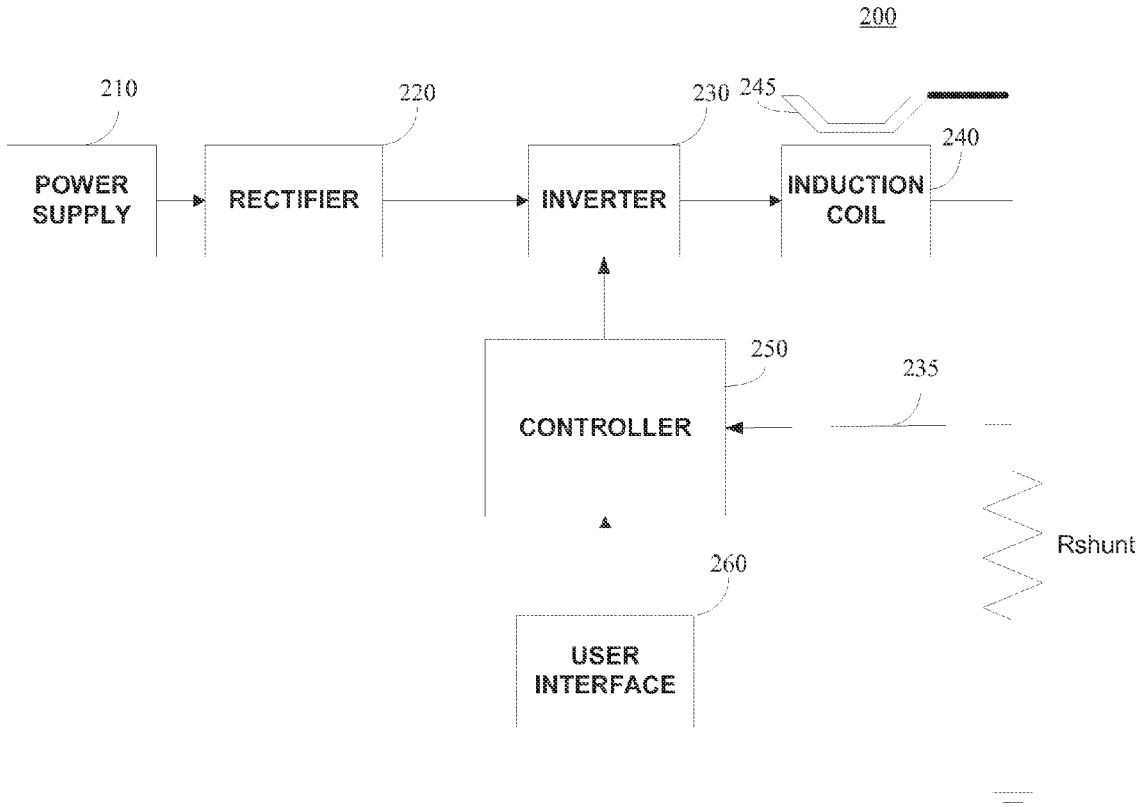
FIG. 2 provides a block diagram of an exemplary induction cooking system according to an exemplary embodiment of the present disclosure.

FIG. 2 provides a block diagram of an exemplary induction cooking system 200 for use with an induction cooktop 10. System 200 can include a power supply 210, a rectifier 220, an inverter 230, an induction coil 240, a shunt resistor ($R_{shunt}$), a controller 250, and a user interface 260.

The user interface 260 can be configured to receive a user input. The user input can include a specific utensil, a utensil material, a utensil size, a selected coil, a type of utensil, a desired cooking level and/or another option.

Power supply 210 can be configured to supply power to the cooking appliance. Generally, power supply 210 can be a two phase, 240 volt alternating current (AC) power supply that is provided to a residential property from an energy production source such as an electric utility. Alternatively, any other power source can be used. For instance, a one phase 120V power supply, a three phase power supply, a generator, a battery, and/or any DC power source.

The rectifier 220 is coupled between the power supply 210 and the inverter 230. When an AC power supply signal is provided, the rectifier 220 can convert the AC power signal into a direct current (DC) signal. This DC signal is input to the inverter 230. Rectifier 220 can include various configurations and devices.

Inverter 230 can be used to convert the DC signal provided from the rectifier 220 into a high-frequency, high power signal to the induction coil 240 to create induction heating used for cooking Inverter 230 can include switching elements, diodes, capacitors, and/or control circuitry. Any type of inverter 230 that includes a plurality of insulated-gate bipolar transistors (IGBTs) or any other switching devices can be used. For instance, a half-bridge inverter, a fully-bridge inverter, or a polyphase inverter can be provided. The inverter 230 can be controlled to provide a high frequency, high power signal to the induction coil 240. For example, the inverter can output a signal in a range from approximately 20-50 kHz.

When a power signal is provided to the induction coil 240 from the inverter 230, a varying or alternating magnetic field can be produced above the induction coil 240. A portion of the generated magnetic field can be coupled to a cookware utensil 245 thereby inducing eddy currents within the utensil 245 that can produce heat for cooking Induction coil 240 can include any configuration or material capable of creating a magnetic field that can produce eddy currents within a cookware utensil. For instance, induction coil 240 can include two conductive plates separated by a dielectric material. In addition, the coil 240 can include windings in a horizontal direction, a vertical direction, or a combination of horizontal and vertical direction.

Cookware utensil 245 can be any size, shape, and/or material that can produce heat when in proximity of the magnetic field generated by the coil 240. For instance, the utensil 245 can have any diameter such as a small or large diameter. The cookware utensil 245 can be a pot, pan, wok, or any other cookware vessel. In addition, cookware utensil 245 can be made of ferrous or semi-ferrous material.

A feedback 235 can be provided to a controller 250 from the induction coil 240 across a shunt resistor ($R_{shunt}$). The controller 250 can detect an electrical signal, such as a signal associated with the shunt resistor ($R_{shunt}$), by feedback 235.

The electrical signal can have a duty cycle. A signal having a duty cycle provides a measure of a percentage of time during a time period the feedback signal is above or below a reference line for one period of the feedback signal. As will be discussed in more detail below, the duty cycle of the electrical signal can be indicative of the position of the cookware utensil in relation to the coil or a change in position of the cookware utensil in relation to the coil.

A duty cycle of a signal can be determined numerous ways. For example, a comparator can be configured to compare a signal to a reference signal to generate an output signal having a duty cycle. The reference signal can be either a fixed reference signal or an adjustable reference signal. The output signal can have a duty cycle that is based on a percentage of the electrical feedback signal that is greater than or less than the reference signal for one period of the electrical feedback signal depending on the comparator configuration. For instance, in a particular implementation, the output of the comparator can have a duty cycle that is based on a percentage of the signal that is above the reference signal. In another particular implementation, the output of the comparator can have a duty cycle that is based on a percentage of the signal that is below the reference signal.

A duty cycle can also be determined using a controller such as a microcontroller, an analog-to-digital controller, or any other controller device. When determining a duty cycle using a controller, the controller can compare the signal to a predetermined threshold value. Alternatively, the signal can be assigned a numerical value and that value can be compared to another predetermined threshold value. When the signal is greater than the predetermined threshold value, the controller can assign a first value to the result and when the signal is less than the predetermined threshold value, the controller can assign a second value to the result. The first and second values can accrue over a period of the signal and a ratio of first values (or alternatively second values) to the total number of values can be used to determine the duty cycle.

The controller 250 can determine the duty cycle of the electrical signal and control the frequency at which the inverter 230 operates based on the duty cycle of the electrical signal. The controller used to determine the duty cycle can be the same controller used to control the power to the inverter or it can be a separate controller coupled to the controller used to control the power to the inverter.

Controller 250 can be positioned in any location within the induction cooktop appliance. For instance, controller 250 can be located under or next to the user interface 30 or otherwise below the horizontal surface 12. Various input/output (I/O) signals can be routed between the controller and various operational components of the appliance, such as user interface 30, inverter 230, coil 240, a display, sensor(s), alarms, and/or other components. In addition, controller 250 can be the only controller of the induction cooktop appliance or it could alternatively be a subcontroller coupled with the overall appliance controller. If controller 250 is a subcontroller, it can be located with the overall appliance controller or be separate from the overall appliance controller.

By way of example, any/all of the "controllers" discussed in this disclosure can include a memory and one or more processing devices such as microprocessors, CPUs or the like, such as general or special purpose microprocessors operable to execute programming instructions or micro-control code associated with operation of an induction cooktop appliance 100. The memory can represent random access memory such as DRAM, or read only memory such as ROM or FLASH. In one embodiment, the processor executes programming instructions stored in memory. The memory can be a separate component from the processor or can be included onboard within the processor. Alternatively, the controller might also be constructed without using a microprocessor, using a combination of discrete analog and/or digital logic circuitry (such as switches, amplifiers, integrators, comparators, flip-flops, AND gates, and the like) to perform control functionality instead of relying upon software.

In a particular embodiment of the present disclosure, an input can be detected at the user interface 260 indicative of a desired cooking operation. For example, a specific burner and a desired cooking level, such as medium, can be selected. This input can be communicated to the controller 250.

A visual feedback can be provided to the user using the user interface 260. For instance, the user interface 260 can provide visual access to information regarding real-time pan-positions indications. When a detected cookware utensil position is within an acceptable range, one indication can be presented to a user such as a green light or other indication of adequate position. When a detected cookware position is outside an acceptable position, a red light or indication of the cookware being off center can be presented to the user.

The controller 250 can initiate operations for the selected cooking operation based on the input detected at the user interface 260. The controller can control the inverter to power the induction coil such that an initial frequency, such as 50 kHz, is supplied to the coil. The initial frequency can then be swept down to a testing frequency, such as 20 kHz. When the testing frequency is supplied to the coil 240, an electrical signal, such as a current or a voltage, can be detected across the shunt resistor ($R_{shunt}$).

In an embodiment of the present disclosure, the sampling frequency of the electrical signal can determined using a zero-cross detector (not shown). The zero-cross detector can be coupled between the power supply 210 and the controller 250. The power supply 210 can provide a power supply signal to the zero-cross detector. When the magnitude of the power supply signal is zero, a timer can be initiated for a time interval t. After time interval t elapses, the electrical signal can be detected across the shunt resistor ($R_{shunt}$).

Time interval t can be defined for any duration. For example, the time interval could be determined such that the electrical signal is detected at a peak magnitude of the power supply signal supplied to the zero-cross detector.

A duty cycle of the electrical signal detected across the shunt resistor ($R_{shunt}$) when the testing frequency is applied to the coil 240 can be determined. The duty cycle can be indicative of the position of the cookware utensil in relation to the induction coil 240. Any changes in the duty cycle of the electrical signal can be indicative of a change in position of the cookware utensil in relation to the coil. For instance, a lookup table, an algorithm, an equation, and/or a model can be used to determine the position based on the change in duty cycle. As a result, the controller can control the power supplied to the coil based on the duty cycle of the electrical signal detected when the testing frequency is supplied to the coil.

Advantages to determining the position of the cookware utensil in relation to the induction coil using the electrical signal across the shunt resistor ($R_{shunt}$) include using a signal that has a good signal-to-noise ratio, reduction in noise due to lack of sensitivity to noise in the system, and a reduction in signal processing and calculation due to using a single signal to determine position.

The electrical signal detected across the shunt resistor ($R_{shunt}$) can be exposed to any type of signal conditioning before and/or after being converted to a signal having a duty cycle. For instance, an amplifier, a filter, a signal sifter, and/or any other type of signal conditioning element can be provided.

After the electrical signal is detected across the shunt resistor ($R_{shunt}$), the controller 250 can increase the frequency of the signal to an operating frequency to the power to the coil to the desired cooking level based on the detected position and a predetermined frequency corresponding to the cooking level. For instance, the test frequency can be swept up to an operating frequency such as 50 kHz.

In an embodiment of the present disclosure, the test frequency can be applied to the coil 240 a plurality of times during a cooking operation. Each time the test frequency is applied, an electrical signal is detected. As will be discussed in more detail below, the duty cycle of the electrical signal can be compared with a baseline cookware utensil characteristic. The controller 250 can dynamically modify the operating frequency during the cooking operation based on the electrical signal detected when the test frequency is applied to the coil.

An alert can be initiated when the duty cycle of the currently detected electrical signal is not substantially equal to the duty cycle of the baseline cookware utensil characteristic indicating a change in position relative to the coil 240. The alert can be any type of alert such as a visual or audio signal.

Alternatively, or in addition to the alert, the controller 250 can disengage all power to the coil to reduce extended exposure of portions of the electrical field generated at the coil.

In another embodiment of the present disclosure, before a cookware utensil is used in a normal cooking operation, a baseline utensil characteristic can be determined and stored in the controller 250. A user can place the utensil on the induction coil 240 and provide information regarding the utensil using the user interface 260. For example, after the utensil is placed directly center on the coil, the user can select or input on the user interface the size, shape, material, and/or other characteristics of the utensil. The controller 250 can save these identifying characteristics in memory.

An initial tuning operation can be performed after identifying the utensil characteristics. The initial tuning operation can include the controller 250 controlling the inverter 230 to supply an initial frequency to the induction coil 240. The initial frequency can be a predetermined frequency above the resonance of the inverter 230, such as 50 kHz. Resonance can occur when the inductive reactance of the inverter 230 is equal to the capacitive reactance.

The frequency is then swept down to a lower tuning frequency, such as 20 kHz. Reducing the initial frequency to the tuning frequency can allow for more precise detection and determination of a cookware characteristic, such as position, because the utensil's influence on the coil output signal is greater at the lower frequency. In one embodiment, the tuning frequency can be substantially identical to the testing frequency described above. An electrical signal, such as a shunt current signal or a shunt voltage signal, can be detected across the shunt resistor ($R_{shunt}$) while the tuning frequency is supplied to the coil 240.

The controller 250 can determine a baseline cookware utensil characteristic based on the saved identifying characteristics and the detected electrical signal. The baseline cookware utensil characteristic can be stored in memory. After the baseline cookware utensil characteristic is stored in memory, the initial tuning operation can be terminated. Terminating the initial tuning operation can include deactivating the power signal to the coil and awaiting further input from a user. In an embodiment, after the initial turning operation is complete, the controller 250 can discontinue further operations of the cooktop system until further input from the user is received.

During a normal cooking operation, a test operation can be performed at predetermined intervals. The test operation can include applying a test frequency to the induction coil and determining the duty cycle of an electrical signal detected across a shunt resistor ($R_{shunt}$) while the tuning frequency is applied to the coil 240, as described above. The electrical signal can be compared to the baseline cookware utensil characteristic to determine the position of the cookware utensil.

Determination of the predetermined intervals between test operations can consider cooking methods that use "flipping the pan" techniques where ingredients are moved around in the cookware utensil by rapidly moving the utensil itself around on the coil. Using this technique, a cooking utensil can repeatedly change the position on the coil and the interval can be determined to avoid detecting the repeated changes.

In an embodiment of the present disclosure, a database of known cookware utensil characteristics can be stored in memory as a lookup table, equation or algorithm. The detected electrical signal can be compared to a predetermined threshold from the known cookware utensil characteristic database to determine a baseline cookware utensil characteristic during an initial tuning operation or the cookware utensil characteristic when a test frequency is supplied to the coil during a cooking operation.

Figure 3:
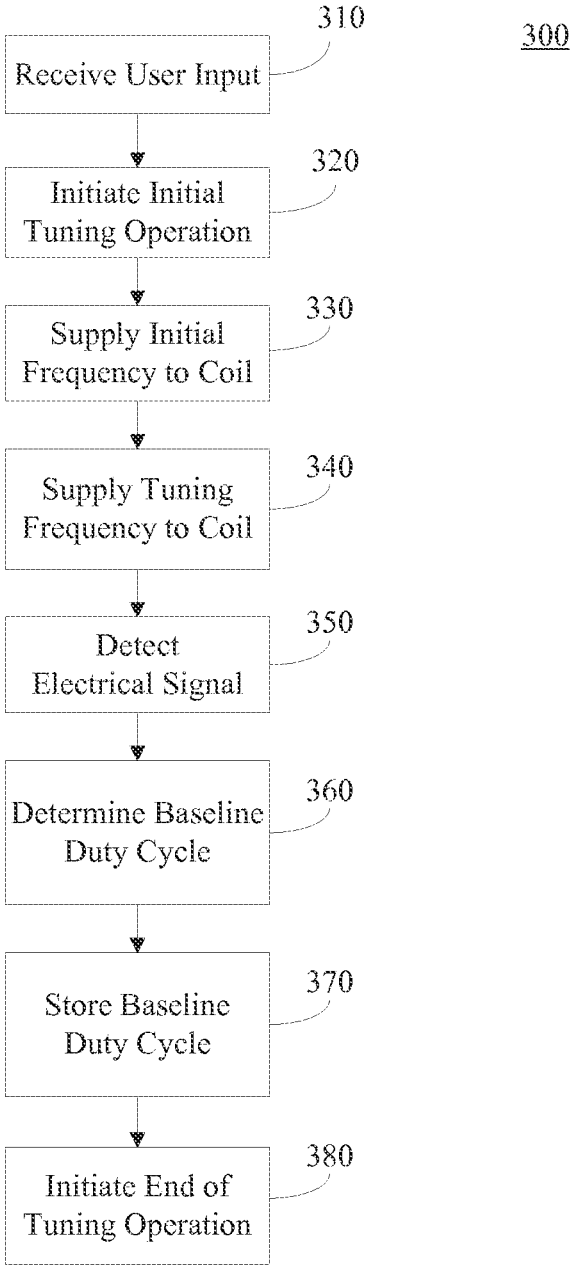
FIG. 3 provides a flow chart of an exemplary method of controlling an induction cooking system according to an exemplary embodiment of the present disclosure.

FIG. 3 illustrates a flow chart of an exemplary method 300 according to an exemplary embodiment of the present disclosure. The method 300 will be discussed with reference to the exemplary induction cooktop system illustrated in FIGS. 1 and 2. However, the method 300 can be implemented with any suitable induction cooktop system. In addition, although FIG. 3 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined and/or adapted in various ways.

FIG. 3 provides a flow chart of an exemplary method 300 of controlling an induction cooking system according to an exemplary embodiment of the present disclosure. In, FIG. 3, an initial tuning operation method 300 can be performed when a cookware utensil is first introduced to the induction cooktop system 100. During the initial tuning operation 300, a cookware utensil is positioned in the center of the induction coil.

A user input can be received at a user interface at (310). The user input can be indicative of the size, shape, material, and/or other characteristic of a cookware utensil placed on the coil. An initial tuning operation can be initiated in (320) and the controller can control the cooktop system 100 to supply an initial frequency signal to a coil at (330). The initial frequency signal can be swept down to a tuning frequency at (340).

An electrical signal can be detected at (650) while the tuning frequency is supplied to the coil. A duty cycle of the electrical signal can be determined and designated as a baseline duty cycle of the cookware utensil at (360). The duty cycle can be indicative of the cookware utensil being centered on the coil. At (370), the baseline duty cycle of the cookware utensil can be stored in memory and an end of tuning operation can be initiated in (380). An end of tuning operation can include preventing high frequency power to be supplied to the coil and awaiting a user input from a user or shutting down the induction cooktop system altogether.

Figure 4:
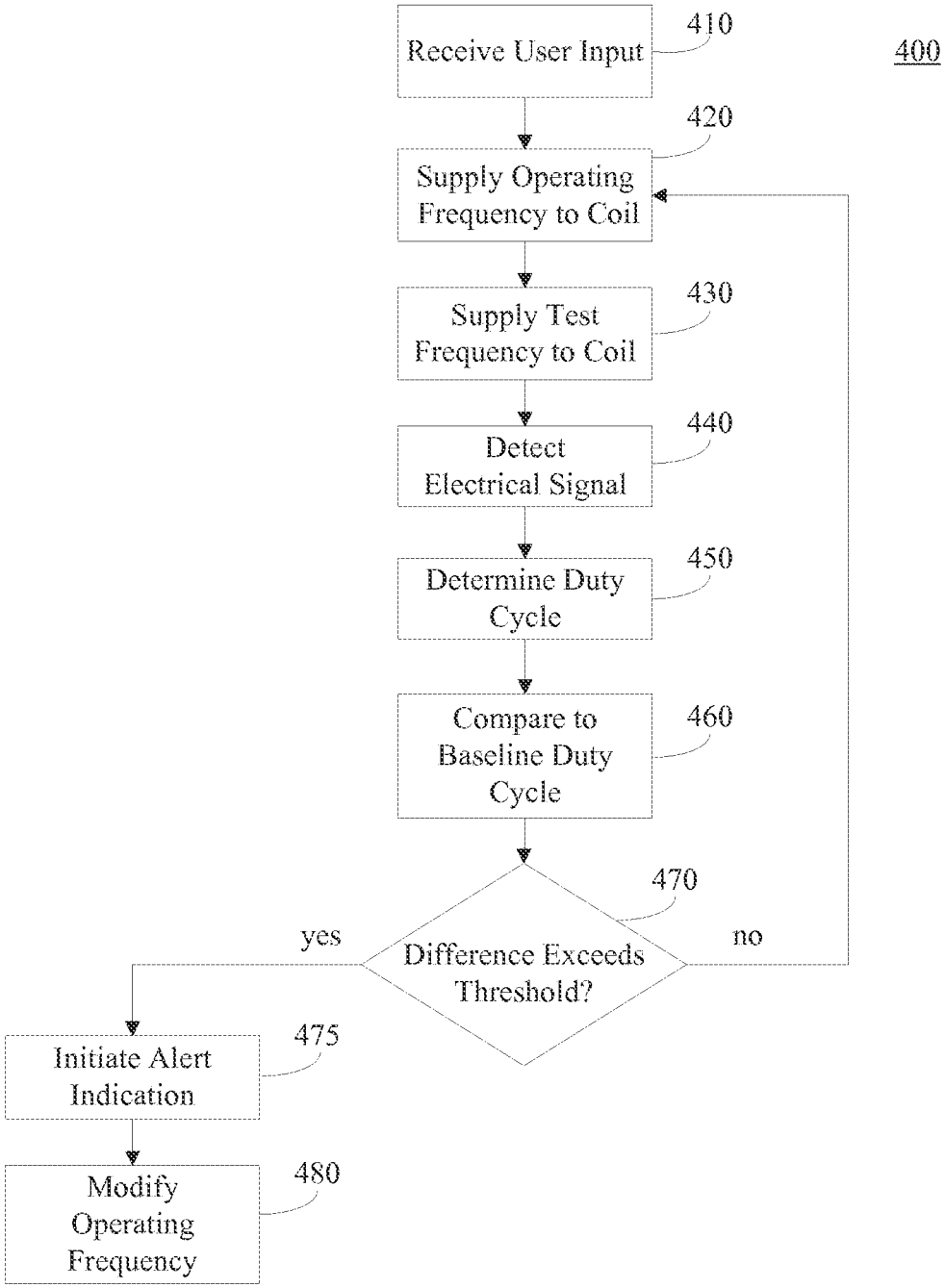
FIG. 4 provides a flow chart of an exemplary method of controlling an induction cooking system according to an exemplary embodiment of the present disclosure.

FIG. 4 illustrates a flow chart of an exemplary method 400 according to an exemplary embodiment of the present disclosure. The method 400 will be discussed with reference to the exemplary induction cooktop system illustrated in FIGS. 1 and 2. However, the method 400 can be implemented with any suitable induction cooktop system. In addition, although FIG. 4 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined and/or adapted in various ways.

FIG. 4 provides a flow chart of an exemplary method 300 of controlling an induction cooking system according to an exemplary embodiment of the present disclosure. In FIG. 4, a user input can be received at a user interface at (410). Based on a user input, the controller can control the cooktop system 100 to supply an operating frequency to an induction coil at (420). The operating frequency signal can be swept down to a test frequency at (430) and an electrical signal can be detected at (440) while the test frequency is supplied to the coil.

A duty cycle of the electrical signal can be determined at (450) and compared to a duty cycle of the baseline cookware utensil at (460). The difference in the duty cycle of the electrical signal and the duty cycle of the baseline cookware utensil characteristic can be indicative of a change in position from a point on the induction coil, such as the center.

The difference in the duty cycles can be compared to a predetermined threshold at (470). The predetermined threshold can be a single value or a range of values. When the difference exceeds the threshold, an alert can be initiated at (475). The alert can be any type of alert such as a visual or audio signal. The controller can modify the operating frequency supplied to the coil at (480) based on the difference between the duty cycle of the electrical signal and the duty cycle of the baseline cooking utensil.

The system and method of detecting a cookware utensil position relative to the coil, described above, reduces electromagnetic field exposure, prologs the life of devices in the system, provides for a more reliable system by improving control of a high frequency, high power signal to a coil. Therefore, the system is more efficient by allowing a more precise control based on a cookware utensil characteristic such as position of the cookware.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of controlling an induction cooktop appliance, comprising:

supplying a test frequency to a coil of the induction cooktop appliance;

detecting an electrical signal across a shunt resistor when the test frequency is supplied to the coil;

determining a position of a cookware utensil based on the electrical signal; and controlling the induction cooktop appliance at an operating frequency greater than the test frequency, the operating frequency being determined based at least in part on the position of the cookware utensil and a predetermined frequency corresponding to a cooking level.

2. The method as in claim 1, wherein the position of the cookware utensil is determined based on the electrical signal and a user input.

3. The method as in claim 2, wherein the user input is indicative of a specific utensil, a utensil material, a utensil size, a selected coil, a type of utensil, or a desired cooking level.

4. The method as in claim 1, wherein detecting an electrical signal across a shunt resistor comprises detecting a shunt current signal or a shunt voltage signal.

5. The method as in claim 1, wherein determining a position of the cookware utensil based on the electrical signal comprises:

determining a duty cycle of the electrical signal;

comparing the duty cycle with a duty cycle of a baseline cookware utensil characteristic; and determining the position of the cookware utensil based on a resulting comparison between the duty cycle and the duty cycle of the baseline cookware utensil characteristic.

6. The method as in claim 5, further comprising initiating an alert indication when duty cycle of the electrical signal deviates from the duty cycle of the baseline cookware utensil characteristic.

7. The method as in claim 5, wherein determining a duty cycle of the electrical signal comprises comparing the electric signal with a predetermined reference signal.

8. The method as in claim 5, wherein the duty cycle of the baseline cookware utensil characteristic corresponds to a specific cookware.

9. The method as in claim 8, wherein determining the baseline cookware utensil characteristic comprises:

receiving a user input indicative of the specific cookware;

supplying an operating frequency to the coil of the induction cooktop appliance;

supplying a tuning frequency to the coil after supplying the operating frequency;

detecting an electrical signal at the shunt resistor based on the tuning frequency;

determining the baseline cookware utensil characteristic corresponding to the specific cookware based on the electric signal; and storing the baseline cookware utensil characteristic corresponding to the specific cookware in a memory.

* * * * *